United States Patent [19]

Ricketts

[11] 3,938,221

[45] *Feb. 17, 1976

[54] MANUFACTURE OF NON-WOVEN MATERIALS

[75] Inventor: Ronald Edmund Ricketts, Pontypool, England

[73] Assignee: Imperial Chemical Industries Limited, London, England

[ * ] Notice: The portion of the term of this patent subsequent to Oct. 9, 1990, has been disclaimed.

[22] Filed: Aug. 20, 1973

[21] Appl. No.: 389,547

Related U.S. Application Data

[63] Continuation-in-part of Ser. No. 73,888, Sept. 21, 1970, Pat. No. 3,763,521.

[30] Foreign Application Priority Data

Oct. 1, 1969 United Kingdom ..... 48196/69

[52] U.S. Cl. ..... 19/155; 156/441

[51] Int. Cl.[2] ..... D01G 5/00

[58] Field of Search ..... 156/167, 181, 433, 441, 156/500, 62.2; 425/66, 72, 329, 462; 19/145, 150, 155; 28/1 SM, 21; 226/168, 170, 172

[56] References Cited

UNITED STATES PATENTS

| | | | |
|---|---|---|---|
| 3,250,602 | 5/1966 | Stalego | 156/167 |
| 3,423,266 | 1/1969 | Davies et al. | 156/167 |
| 3,615,998 | 10/1971 | Kolb et al. | 156/167 |
| 3,647,597 | 3/1972 | Voss et al. | 156/62.2 |
| 3,758,373 | 9/1973 | Rich | 156/167 |
| 3,763,521 | 10/1973 | Ricketts | 19/155 |
| 3,781,393 | 12/1973 | Feltgen et al. | 156/167 |

*Primary Examiner*—Douglas J. Drummond
*Assistant Examiner*—Michael W. Ball
*Attorney, Agent, or Firm*—Cushman, Darby & Cushman

[57] ABSTRACT

Apparatus for forming a tubular non-woven web comprising filament supply means and filament forwarding means, between which there is no cumulative angular motion, and a filament collector comprising a number of continuous belts arranged to form a vertical channel, onto the inside wall of which the forwarding means project filaments to form a non-woven web. There are at least two filament forwarding means. The continuous belts are synchronously driven to carry the non-woven web away from the filament forwarding means.

6 Claims, 8 Drawing Figures

Figure 1:
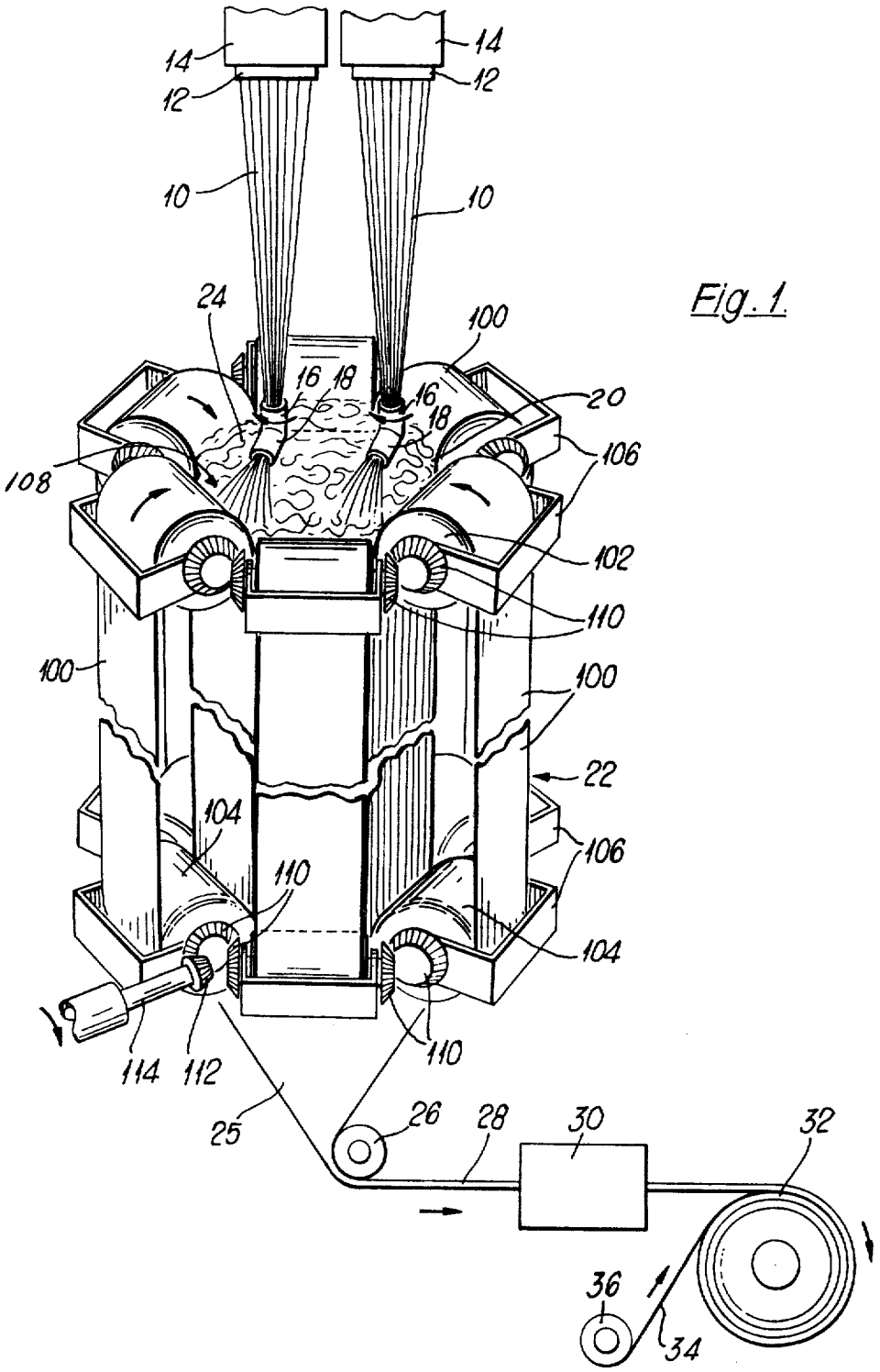

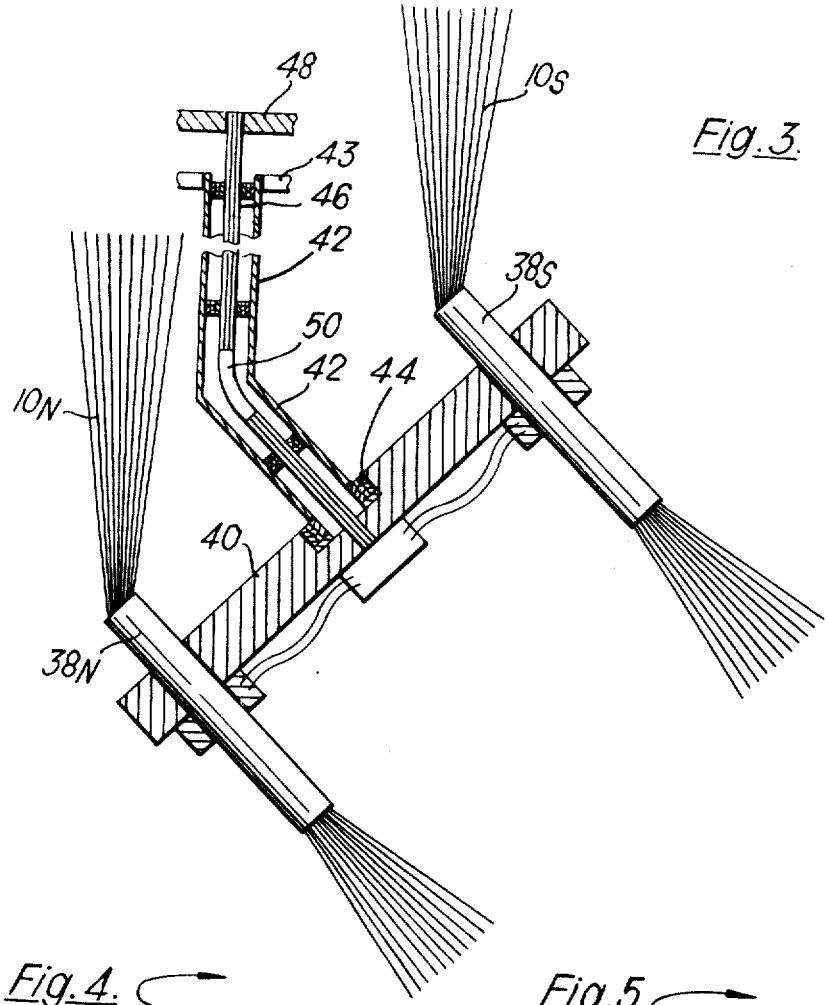
Fig. 3.
Fig. 4.
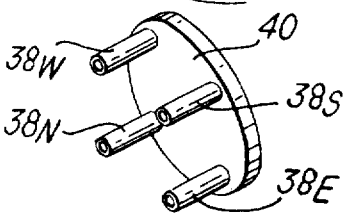
Fig. 5.
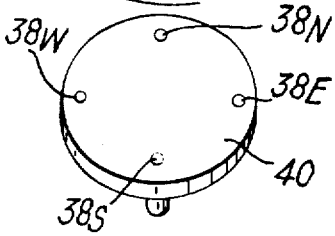
Fig. 6.
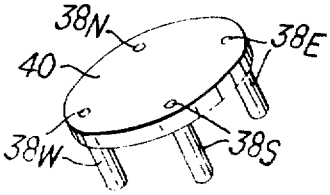
Fig. 7.
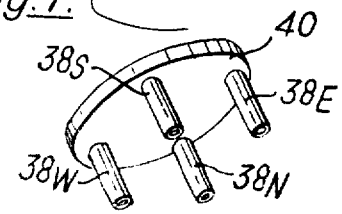

MANUFACTURE OF NON-WOVEN MATERIALS

This is a continuation-in-part application of application Ser. No. 73,888 filed Sept. 21, 1970, now U.S. Pat. No. 3,763,521.

The invention relates to apparatus for manufacture of non-woven fabrics comprising continuous synthetic filaments. More particularly, the invention relates to apparatus of forming non-woven materials by deposition of continuous filaments on a collecting surface.

In the past, non-woven structures comprising continuous filaments have been made by the deposition of the filaments on to an advancing collector surface. Many variations on basic manufacturing technique have been disclosed, such as for example, depositing a curtain of filaments upon an advancing conveyor, forwarding filaments by means of stationary forwarding devices onto an advancing collector or forwarding filaments by means of forwarding devices arranged to reciprocatably traverse perpendicularly to the direction of advance of the collector surface. The collector surface has comprised a flat conveyor, a rotating drum or a flat rotating disc, and the purpose of the surface is to remove the filaments as they are laid into a non-woven structure from the laydown zone.

A major criterion in the success of a particular method of forming the non-woven sheet is the uniformity of the product, as measured for example by the weight per unit area. When a single stationary, forwarding or depositing means is employed a uniform non-woven product is quite readily achieved, but the provision of a plurality of forwarding or depositing means, and/or reciprocating motion of a single forwarding means, as has been frequently proposed, requires much more complicated arrangements in order to ensure a uniform product. A particular disadvantage of those methods of manufacture of continuous filament non-woven webs employing a multiplicity of forwarding means and/or reciprocating means was that the edges of the non-woven structure were of a different weight per unit area to the main body of the structure. In order to overcome this non-uniformity it proved necessary to trim away the edges of the product so that only the central, uniform portions remained. The cost of manufacturing edge portions which are subsequently trimmed off and wasted is obviously undesirable and clearly a need exists for a method, or apparatus, for manufacture at high throughputs of a non-woven web of uniform weight per unit area even at its edges without trimming.

It is an object of the invention to provide novel apparatus for the manufacture of non-woven webs. Another object of the invention is to provide an apparatus for the manufacture of a uniform continuous filament non-woven webs using a multiplicity of filament forwarding devices. Other objects of the invention will become apparent during the detailed description which follows.

Accordingly, the invention provides apparatus for making a non-woven web comprising filament supply means, two or more filament forwarding means and a filament collector, said collector comprising a plurality of vertically arranged continuous belts which are arranged side-by-side so as to define a vertical channel, the inner wall of which provides a collection surface for said filaments, the exit passage at least of said forwarding means being inclined at an angle to the axis of the channel, and means causing preferably uniform relative angular motion between said forwarding means and said channel such that the mean distance between said forwarding means and the surface of said channel remains substantially constant while ensuring that the overall relative angular motion between filament supply means and the inlets at least of the filament forwarding means is at least substantially zero, so that said filaments are projected on to said collection surface to form a non-woven web, and means causing said belts to be driven in continuous synchronous manner to convey said non-woven web away from said filament forwarding means.

The invention proposes relative angular motion between the forwarding means and the channel. Thus both forwarding means and filament collector may rotate or preferably either one or the other may be stationary. If the filament collector is rotated, it then becomes necessary to rotate associated apparatus for winding up the web about the axis of the filament collector at the same angular velocity as the collector in order to avoid twisting of the web, and engineering, maintenance and doffing complications are thereby encountered. Therefore, in a highly preferred embodiment of the invention the collector surface member is not rotated and the filament forwarding means is moved so that the direction of spraying proceeds at a preferably constant angular velocity. However, in the latter case it is necessary, in order to prevent interference between and twisting of, the threadlines between the supply means and the forwarding devices that there is no accumulative relative rotational motion between the supply means and the inlet ends of the forwarding devices. The means in which this requirement may be met in practice are set forth in greater detail hereinafter.

The production of a tubular non-woven web has valuable advantages over known techniques of producing continuous filament webs in which continuous filaments are deposited on a flat collecting surface by means of a filament forwarding device which is traversed to and fro above the collecting surface. Amongst these advantages mention may be made of the compactness of the apparatus compared with conventional machinery for manufacturing a non-woven web of comparative width, which renders the apparatus extremely valuable in production where frequently floor space is at a premium. The production of a tubular non-woven web by the apparatus of the invention further provides a means of attaining higher productivity, since high traverse speeds are obtainable because there is no sudden change in velocity of the filament forwarding means and furthermore the web produced may be made completely uniform across its width whereas webs made by conventional traversing forwarding devices depositing filaments on a horizontal collecting surface have edges having a different weight.

The means for collecting the web will usually comprise means whereby the tubular web may be wound up on a roller in an orderly manner although alternative collecting means such as piddling the web into a collecting can are not excluded.

The web may be collected as a "lay-flat" doubled web. Alternatively, if a web having a large width is desired, the tubular web produced by the process of the invention may be slit once along its length. Slitting may be performed by conventional means such as cutting, shearing or by thermal means.

The web may be subsequently treated in known manner to produce a non-woven product. For example the web may be impregnated with an adhesive and heated to bond the fibres together, or the web may contain composite filaments, having a component which may be rendered adhesive under conditions which leave the other component(s) substantially unaffected, per unit area to the remainder of the web, because of the finite time taken to effect reversal of direction of traverse of the forwarding devices.

The tubular or slit-tubular web produced may be readily bonded by methods available from the art. Thus the web may be impregnated with an adhesive binder which may be applied as a solid, a liquid or a solution with such further treatment as may be necessary so as to effect bonding. In a preferred embodiment the web comprises bicomponent filaments, one component of which occupies at least a proportion of the periphery of the filament and may be rendered adhesive under conditions which leave the other component substantially unaffected, thereby forming bonds between contiguous filaments.

The hollow tubular member is composed of a plurality of vertically arranged continuous belts which abut or overlap at their edges. The belts may be driven in synchronous manner so that the internal wall formed thereby descends at a speed determined by the throughput of the filament advancing means and the desired weight of product. The belts or sheets may be impervious or foraminous, as desired, to which the filaments adhere. We believe that the filaments become charged with static electricity during their passage through the forwarding means and as a consequence adhere to the collection surface, and are carried away from the filament forwarding means thereby, yet are not adhered thereto so firmly that the non-woven web is sensibly damaged as it is pulled off the belts at the base of the collector.

The filamentary material forming the web will generally be found to adhere to the walls of the collection surface by means of static charge, but if necessary suction may be applied from the remote side of the collection surface in order to increase adherence. Should the static charge be so great as to cause such adherence between filaments and the collection surface that the web is damaged by the haul-off tension, the charge, and consequently the adherence, may conveniently be reduced by injecting steam or moisture. Injection may be performed by a nozzle associated with the forwarding means.

The belts may be formed from any flexible material, such as rubbers, which may or may not be reinforced by textile scrims, or may be a flexible foraminous material such as a woven metal mesh. The exhausts of the forwarding means are inclined at an angle to the axis so that filaments are caused to impinge upon the hollow collecting cylinder.

A substantially constant weight per unit area along the web will be obtained if the distance the web is withdrawn per revolution of the forwarding means is small compared with the width of the band deposited by the forwarding means. For example, it is frequently found that the spray distribution is substantially Gaussian in which case the maximum advance of the web per revolution of the forwarding means, in order to ensure a substantially uniform product, is equal to the half peak width of the distribution. A substantially uniform web will be produced if the ejectors are symmetrically disposed around the vertical axis of the collecting cylinder, and the condition discussed above is complied with. Quality of the web may be improved if, for a given throughput of filaments through the forwarding means and given product weight, a high relative velocity between forwarding means and collecting surface together with a low web withdrawal speed are employed.

It is of course necessary to avoid any twisting together and interference between the individual threadlines feeding the several forwarding means. This can be achieved by keeping the forwarding means and filament supply stationary and arranging for the collection surface and associated wind-up apparatus to rotate in tandem. However, as stated above, we prefer where possible that collection surface is stationary. Another possibility is that filament supply means and forwarding means are both rotated with the same angular velocity. The third, highly preferred alternative is to maintain filament supply means and collecting surface stationary, and to cause the direction in which the exit of the forwarding means points to proceed at uniform angular velocity whilst ensuring little relative movement, and no accummulated relative movement between supply means and the inlet end of the forwarding means. In order to avoid interference between threadline paths after forwarding, all exits of the filament forwarding means should point in substantially the same direction. This may be achieved by mounting the plurality of forwarding means on a tilted non-rotatable plate and arranging for the plane of tilt to proceed at uniform angular velocity, which is a modification of the so-called "Swash Plate" member. The motion of the tilted plate is analogous to the precession of the axis of a spinning body around an axis of rotation and for convenience the motion will be referred to as a precession. Alternatively, several ejectors may be mounted on a fixed horizontal plate symmetrically above the axis of the channel and having exit orifices inclined at an angle to that axis.

When the diameter of the collecting channel is large it may not prove possible to arrange the threadline forwarding means to be centrally aligned above the collector, since the distance that the filaments must travel from forwarding means to impinge upon the collector is undesirably large. In such cases, one rotatable swash plate carrying a plurality of ejectors may be mounted conveniently near to the collector surface on an arm, extending from a centrally mounted rotatable shaft.

Figure 2:
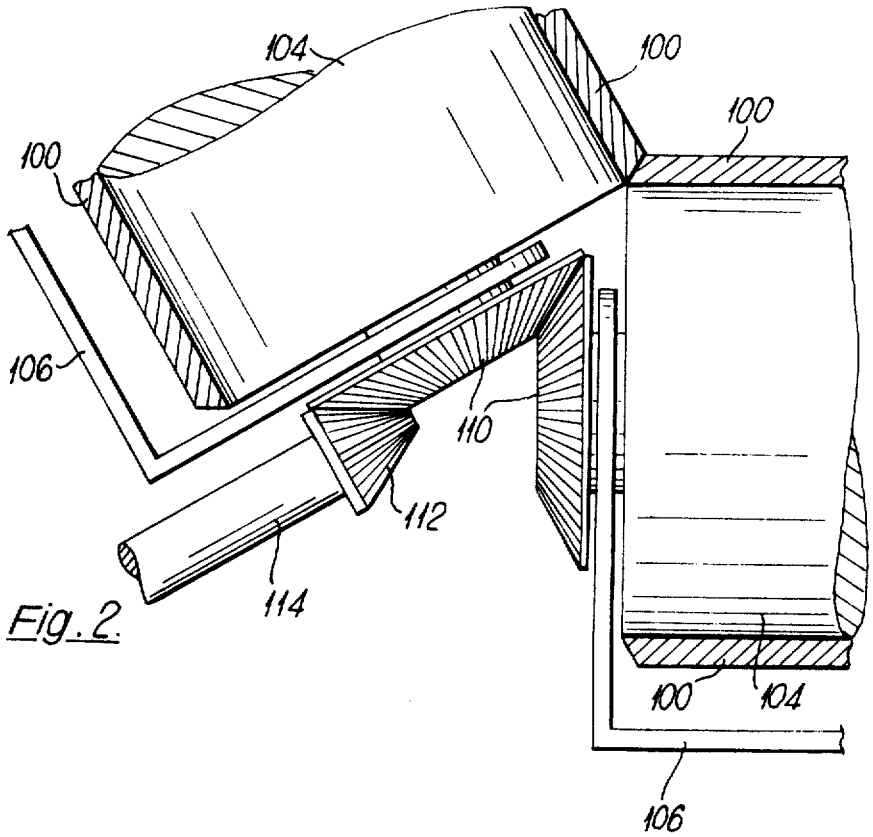

The invention is now described further with reference to the accompanying drawings in which:

FIG. 1 is a schematic perspective representation of one form of the apparatus according to the invention, FIG. 2 is a plan view of part of the apparatus shown in FIG. 1, showing a drive mechanism for the endless belts comprising the filament collector, FIG. 3 is a section through a preferred yarn forwarding device, comprising two ejectors mounted on a rotatable swash plate, forming part of the apparatus of the invention and FIGS. 4, 5, 6, 7 show perspective views of a swash plate device similar to that illustrated in FIG. 3 but having four ejectors, in various attitudes.

Figure 8:
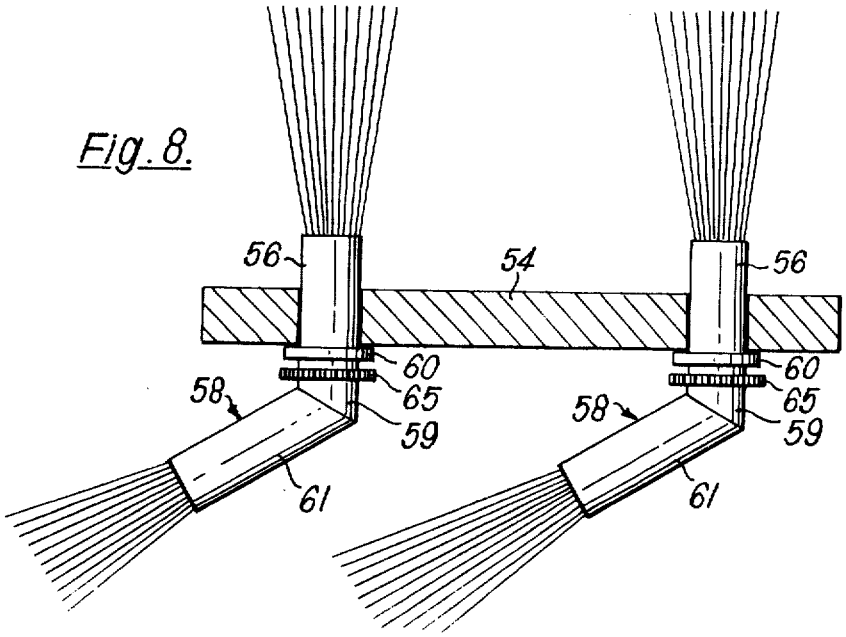

FIG. 8 is a section through an alternative forwarding device forming part of the apparatus of the invention.

Referring to FIGS. 1 and 2, continuous filaments 10 of a synthetic polymer are passed from spinnerets 12 integrally connected to spinning units 14, to pneumatic forwarding devices 16. The exit nozzles 18 of forwarding devices 16 are parellel at all times and inclined so as to project continuous filaments 10 without interference between the two masses of projected filaments 10 onto the internal wall l20 of collecting surface 22, illustrated as six endless belts 100 hexagonally arranged when viewed in a vertical plane. Endless belts 100 are arranged to pass over top rolls 102 and bottom rolls 104 which are individually axially mounted on supports 106, which are themselves fixed to a rigid structure (not shown). Supports 106 are arranged so that each belt 100 abuts with its neighbours to define a hexagonal vertical channel 108. Rolls 102 and 104 have bevel gears 110 axially mounted at each end and outside supports 106, said bevel gears 110 being in meshing engagement at their inner sides (see FIG. 2). Bevel gears 110 are also meshed with bevel driving pinion 112 whereby the belts 100 may be driven by shafts 114, which are rotated so that belts 100 pass downwardly on the inside of the hexagonal passage that they define. Only one shaft 114 is shown: it will be readily appreciated that a plurality of shafts 114 may be employed, with mechanical, electrical hydraulic or electronic means (not shown) to ensure synchronous operation. The edge of each belt 100 may be appropriately chamfered so as to improve its abutment with its neighbouring belts 100.

Forwarding devices 16 are situated on opposite sides of, and close to the axis of collector 22 and are arranged to rotate at constant angular velocity. A web 24 of continuous filaments is built up on the internal surface 20 of collector 22. Cylindrical web 25 is passed on exiting from collector 22 around curved roll 26 which serves to lay-flat the tubular web 25 to form a doubled web 28. If desired web 25 be slit along a length by slitting means (not shown) and opened by guide rolls (not shown) to form a single web, which would then proceed via roll 26 to occupy the position of web 28. Reference numeral 30 indicates schematically further treatment of web 28 whereby the filaments thereof are bonded together and web 28 is finally collected on roll 32 and may be interleaved by tissue paper 34 supplied from roll 36 if desired.

FIG. 3 illustrates a convenient form of pneumatic forwarding device 16, by which a plurality of individual bundles of continuous filaments 10 can be supplied to a forwarding device to increase throughput. For convenience, two threadlines are illustrated, and their relative positions are indicated by the suffixes N, S, being two cardinal points of a compass. Thus, threadlines $\mathbf{10}_N$, $\mathbf{10}_S$, are passed to the pneumatic forwarding device which comprises air ejectors $\mathbf{38}_N$, $\mathbf{38}_S$, mounted perpendicularly to inclined swash plate 40.

Swash plate 40 is supported by vertical rigid hollow shaft 42 bent at its lower end and fixed thereat to ball race 44 embedded in plate 40. The vertical portion of shaft 42 is aligned with the axis of the collector (not shown in FIG. 3) and is rotatably driven by means of a chain or belt (not shown) running in contact with pulley or sprocket 43. Internally situated of shaft 42 is pneumatic supply tube 46 whereby ejectors $\mathbf{38}_N$, $\mathbf{38}_S$, are powered. Tube 46 is rigidly mounted to frame 48 and contains flexible portion 50.

In operation, shaft 42 is rotated, thereby causing the plane of tilt of plate 40 to precess whilst stationary flexible supply tube 46 prevents plate 40 from rotating. By this means, ejectors $\mathbf{38}_N$, $\mathbf{38}_S$ are held substantially in the same position relative to threadlines $\mathbf{10}_N$, $\mathbf{10}_S$, whilst the direction in which threadlines $\mathbf{10}_N$, $\mathbf{10}_S$ are propelled by ejectors $\mathbf{38}_N$, $\mathbf{38}_S$ precesses.

FIGS. 4, 5, 6, 7 illustrate in perspective four successive attitudes of swash plate 40 carrying four ejectors $\mathbf{38}_N$, $\mathbf{38}_S$, $\mathbf{38}_E$, $\mathbf{38}_W$ in the course of one revolution.

FIG. 8 shows a second yarn forwarding device. Stationary plate 54 supports a number of air ejectors (two only shown). The ejectors comprise a non-rotating portion 56 and a rotatable portion 58, the two portions being linked at bearing 60. Rotatable portions 58 comprise a first section 59 coaxial with fixed portion 56 and a second portion 61 set at an angle to portion 59. First sections 59 of rotatable portions 58 are adapted to engage with a driving belt or chain (not shown): the portion engaging the driving means is indicated by reference numeral 65. The axes of second portions 61 preferably remain parallel and for this reason positive engagement between driving means and rotatable portions 58 is preferred, such as that afforded by a toothed wheel and a chain or ribbed belt.

I claim:

1. Apparatus for making a non-woven web comprising filament supply means, two or more filament forwarding means and a filament collector, said collector comprising a plurality of vertically arranged continuous belts which are arranged side-by-side so as to define a vertical channel, the inner wall of which provides a collection surface for said filaments, the exit passage at least of said forwarding means being inclined at an angle to the axis of the channel, and means causing preferably uniform relative angular motion between said forwarding means and said channel such that the mean distance between said forwarding means and the surface of said channel remains substantially constant while ensuring that the overall relative angular motion between filament supply means and the inlets at least of the filament forwarding means is at least substantially zero, said forwarding means including a plurality of air injectors mounted upon a tilted non-rotatable plate and means for causing the plane of the tilt of said plate to proceed at a uniform angular velocity, so that said filaments are projected on to said collection surface to form a non-woven web, and means causing said belts to be driven in continuous synchronous manner to convey said non-woven web away from said filament forwarding means.

2. Apparatus for making a non-woven web according to claim 1 wherein said belts comprise a flexible rubber material.

3. Apparatus for making a non-woven web as claimed in claim 1 wherein said belts are a foraminous flexible material.

4. Apparatus for making a non-woven web comprising filament supply means, two or more filament forwarding means and a filament collector, said collector comprising a plurality of vertically arranged continuous belts which are arranged side-by-side so as to define a vertical channel, the inner wall of which provides a collection surface for said filaments, the exit passage at least of said forwarding means being inclined at an angle to the axis of channel, and means causing preferably uniform relative angular motion between said forwarding means and said channel such that the mean distance between said forwarding means and the surface of said channel remains substantially constant while ensuring that the overall relative angular motion between filament supply means and the inlets at least of the filament forwarding means is at least substantially zero, said forwarding means comprising a plurality of air ejectors mounted symmetrically about the axis of the channel on a stationary plate which is substantially co-axial with the channel, said air ejectors comprising a stationary inlet means and a rotatable outlet means, said outlet means being inclined at an angle to the axes of the channel and the axes of all said outlet means being substantially parallel, so that said filaments are projected on to said collection surface to form a non-woven web, and means causing said belts to be driven in continuous synchronous manner to convey said non-woven web away from said filament forwarding means.

5. Apparatus for making a non-woven web according to claim 4 wherein said belts comprise a flexible rubber material.

6. Apparatus for making a non-woven web as claimed in claim 4 wherein said belts are a foraminous flexible material.

* * * * *